US006129154A

United States Patent [19]

Hoffmann et al.

[11] Patent Number: 6,129,154

[45] Date of Patent: Oct. 10, 2000

[54] SPRAY NOZZLE, ESPECIALLY FOR SPRAYING WATER IN FIRE PREVENTION SYSTEMS

[75] Inventors: Rolf Hoffmann; Jörg Mücke, both of Oschersleben; Wilfried Heize, Harzgerode, all of Germany

[73] Assignee: Minimax GmbH, BedOldesloe, Germany

[21] Appl. No.: 08/635,599

[22] Filed: Apr. 22, 1996

[51] Int. Cl.[7] ..... A62C 2/00

[52] U.S. Cl. ..... 169/47; 239/406; 239/8; 169/37

[58] Field of Search ..... 239/487–489, 239/405, 8; 169/37, 47

[56] References Cited

U.S. PATENT DOCUMENTS

| | | | |
|---|---|---|---|
| 1,395,442 | 11/1921 | MacGregor | 239/487 X |
| 2,134,347 | 10/1938 | Thompson | 239/487 X |
| 2,801,881 | 8/1957 | Campbell | 239/489 X |

FOREIGN PATENT DOCUMENTS

| | | | |
|---|---|---|---|
| 848456 | 3/1977 | Belgium . | |
| 473630 | 1/1915 | France . | |
| 606356 | 6/1926 | France | 239/405 |
| 141626 | 3/1979 | Germany . | |
| 245825 | 5/1987 | Germany . | |
| 166515 | 11/1922 | United Kingdom | 239/405 |

*Primary Examiner*—Kevin Weldon
*Attorney, Agent, or Firm*—Olson & Hierl, Ltd.

[57] ABSTRACT

A spray nozzle, especially for spraying water in fire prevention systems, has a housing in which there is a vortex chamber into which a first channel into which a first channel for supplying water opens essentially tangentially at a distance from the axis of the vortex and which has a first outlet orifice coaxial with the axis of the vortex. The spray nozzle also has a second outlet orifice arranged inside the vortex chamber so it is coaxial with the first outlet orifice and is located at the end of a second channel that is coaxial with the axis of the vortex. The second channel has an enlarged area upstream from the second outlet orifice, where the cross-sectional area at right angles to the axis of the channel increases in the direction of flow. furthermore, the cross-sectional area of the second channel at right angles to the axis of the channel does not decrease further downstream from the enlargement as seen in the direction of flow. The second outlet orifice is positioned so close to and upstream from the first outlet orifice that a low pressure zone is formed in the enlarged area, distributing the flowing water to form a spray cone that comes out of the second outlet orifice and spreads out inside a spray cone coming out of the first outlet orifice. This yields a uniform fire extinguishing effect and the width of the spray created by the spray nozzle is increased. The spray nozzle according to this invention is simple and inexpensive to manufacture.

8 Claims, 1 Drawing Sheet

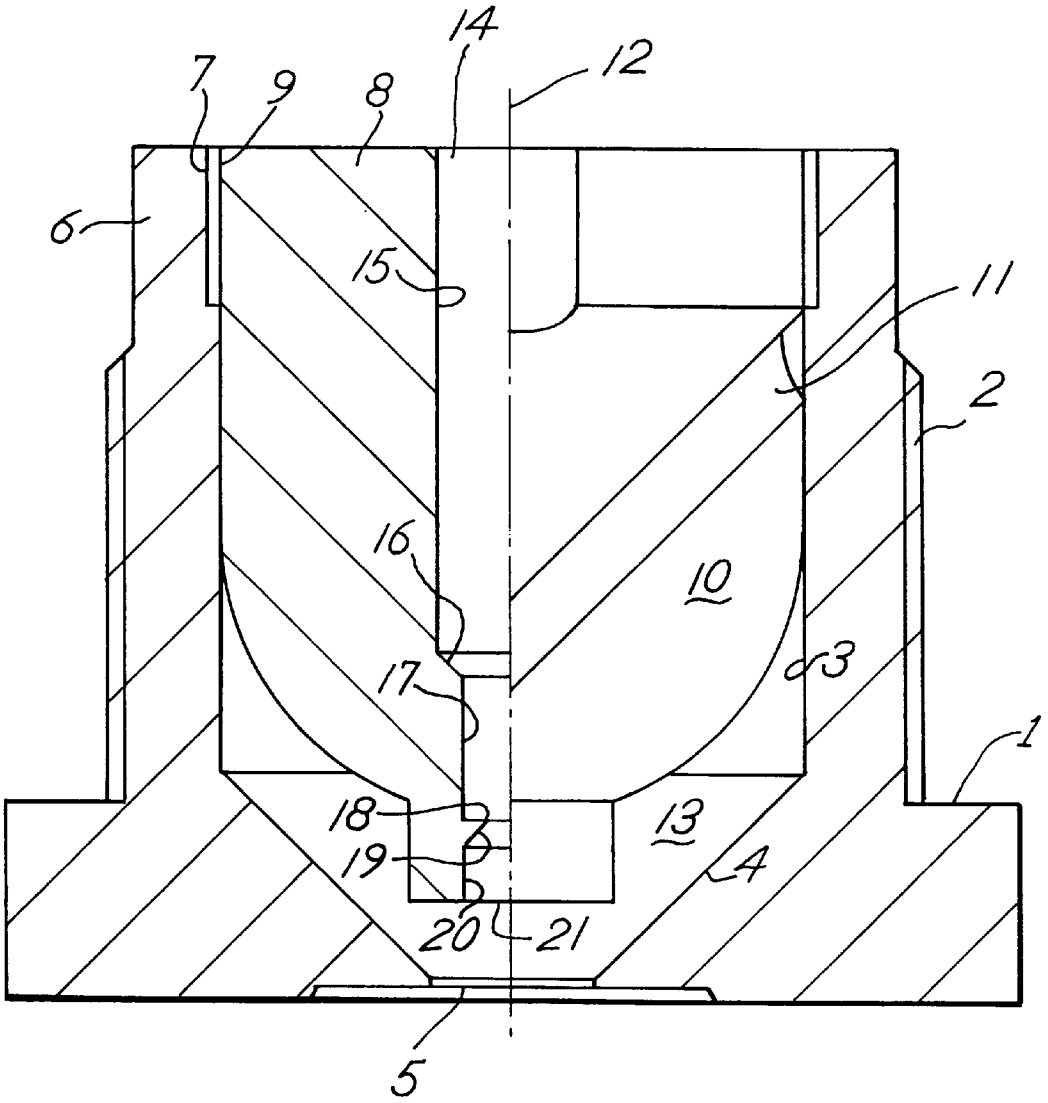
14
12
7
9
8
6
15
11
2
16
10
3
17
1
18
13
19
4
20
21
5

SPRAY NOZZLE, ESPECIALLY FOR SPRAYING WATER IN FIRE PREVENTION SYSTEMS

BACKGROUND OF THE INVENTION

This invention concerns a spray nozzle of the type specified in the preamble to claim 1, especially for spraying water in a fire prevention system.

Spray nozzles have been available for a long time. They have harrow helical channels that open tangentially into a vortex chamber that is connected to a narrow coaxial nozzle orifice. Rotation of the flowing liquid medium such as water is induced by the helical channels. The rotational speed is increased greatly along the radial path inward to the narrow coaxial nozzle orifice, so that as the water leaves the nozzle orifice it is flung outward due to the centrifugal forces prevailing at that point, thus forming a spray mist that spreads out essentially in a spray cone.

One disadvantage of this spray nozzle is that there is very little spray mist inside the spray cone, thus forming an area where there is little or no spray, especially at the center of the spray cone, so the fire extinguishing effect of the spray mist is much lower there.

East German patent DD 141,626 discloses a spray nozzle having a housing in which a first nozzle part is mounted. A first vortex chamber is formed between the first nozzle part and an inside wall of the housing. A first helical channel for supplying water is provided on the outside of the first nozzle part, opening tangentially into the first vortex chamber at a point remote from the axis of the vortex and having a first outlet orifice coaxial with the axis of the vortex. A second vortex chamber is formed between an inside wall of the first nozzle part and a second nozzle part arranged inside the first nozzle part, and a second helical channel for supplying water is provided on the outside of the second nozzle part, opening tangentially into the second vortex chamber at a point remote from the axis of the vortex and having a second outlet orifice coaxial with the axis of the vortex. When this spray nozzle is used, some water flows through the helical first channel to the first outlet orifice, so a spray mist in the firm of a first spray cone is formed under the spray nozzle. In addition, water also flows through the second helical channel to the second outlet orifice, so a spray mist is produced in the form of a second spray cone under the spray nozzle. The second spray cone has a smaller cone angle than the first spray cone, so the interior of the first spray cone is filled with a spray mist by the second spray cone and therefore an extinguishing effect is also achieved in the interior of the first spray cone.

One disadvantage of the known spray nozzle consists of the fact that its design is complicated due to the second nozzle part arranged inside the first nozzle part as required to produce the second spray cone, so the known spray nozzle is expensive to manufacture.

When assembling the known spray nozzle, first the second nozzle part must be screwed into the first nozzle part and then the first nozzle part is screwed into the housing. Thus, several steps are involved in the manufacture of this spray nozzle. This is time consuming, thus further increasing the cost of manufacturing the known spray nozzle.

Since the second nozzle part is arranged inside the first nozzle part, it has small dimensions, so the cross section of the second channel provided on the outside of the second nozzle part is also small accordingly. There is thus the danger that the second channel might become clogged due to the penetration of dust, etc. As a result, the second spray cone produced by the second nozzle part is formed inadequately or not at all, so the fire extinguishing effect of the spray nozzle is impaired. In addition, the width of the spray cone of the second swirl nozzle is rather small.

East German patent DD 245,825 A1 discloses a spray nozzle consisting of a hollow nozzle body with a break-away angle of 120° at the outlet orifice of the nozzle head into which a nozzle insert part having spiral grooves on the outside and a hollow screw on the inside is inserted, where the nozzle insert in the hollow body of the nozzle leaves open a rinsing space where the water enters into a rotating decompression phase while at the same time there is a build up of pressure in front of the outlet orifice, and after flowing through the outlet orifice, a water cone is formed that produces a dispersion effect at the break-away angle of the nozzle head, thus improving the spray pattern by reducing the droplet size. Due to the rotation of the water in the rinsing space, the water is distributed in the form of a spray cone at the outlet orifice of the nozzle head. Since all the droplets are subject to the prevailing centrifugal force, a conical space that is essentially free of droplets is formed inside the spray cone. Thus, when this spray encounters a surface to be extinguished, only a ring of the surface is actually sprayed, but the inside of the ring does not receive any spray. Therefore, this known swirl nozzle has a very low fire extinguishing effect.

French patent 473,630 discloses a spray nozzle of the type in question, where the swirl chamber is designed in a trumpet shape and is sealed off by a wall in the wide intake area where there is a slot through which water enters the swirl chamber with a velocity component in the circumferential direction. This water forms a layer along the inside wall of the trumpet-shaped swirl chamber and flows along it to the tapering part of the swirl chamber, leaving as a spray cone because of the rotational component of the velocity.

At the center of the wall sealing off the trumpet-shaped swirl chamber there is a short nozzle out of which a stream of water enters the swirl chamber coaxially, leaving a hollow space in most of the swirl chamber between this central stream and the flow running along the inside wall of the swirl chamber. This bundled coaxial stream passes through the constricted part of the swirl chamber, with the rotating flow extending outside this bundled stream. The outer part of the bundled stream is rotated by entrainment, so its components are distributed to form a spray cone when leaving the tapered part of the swirl chamber, while the inside part of the bundled stream leaves the swirl chamber as a stream that is largely unaffected. This yields a fire extinguishing pattern with the bundled stream at the center next to a conical space on the outside that is largely free of spray mist, while a ring-shaped spray range extends toward the outside again. Therefore, this known spray nozzle does not have a good extinguishing effect, and furthermore there is an undesirable concentration of fire extinguishing water at the center.

The object of this invention is to make available a spray nozzle of the type in question that does not have the disadvantages of the known spray nozzle, that has a simplified design and is inexpensive to manufacture and assures reliable operation.

This object is achieved by the teaching characterized in patent claim 1.

The idea on which this invention is based consists of the fact that instead of a second inner swirl nozzle, there is a second channel that is coaxial with the axis of the vortex of the swirl chamber and a pressure gradient is produced in the direction of flow upstream from the second outlet orifice so the water flowing through the second channel is distributed to form a spray cone in the transition to a lower pressure range.

The spray mist produced in this way is distributed in the interior of the spray cone leaving the swirl chamber, so the desired fire extinguishing effect is also achieved inside this spray cone. Furthermore, the spray mist leaving the second outlet orifice has a higher velocity and thus also a greater spray width.

The second channel may be formed by a continuous recess that runs in the longitudinal direction of the nozzle part and is easy to produce. The spray nozzle according to this invention is thus simple and inexpensive to manufacture.

According to an embodiment of this invention, the enlarged area is formed downstream from a narrow portion of the cross section of the second channel as seen in the direction of flow. In this embodiment, the reduction in cross section and the widened portion following it form an orifice where a great pressure gradient develops, so the water is distributed to form a spray mist especially effectively.

According to another embodiment, the enlarged area is formed by a conical wall area of the second channel. In this embodiment, an especially simple way to produce the second channel is by producing a bore with gradations in diameter, where the reduction in cross section in the direction of flow is preferably designed with incremental stages.

In another embodiment of this invention, a nozzle part is arranged in the housing with the first channel on the outside and the second channel in the center.

Due to suitable dimensions of the second channel, especially the enlarged area and/or the reduction in cross section, the shape and droplet size of the spray mist leaving the second outlet orifice can be influenced within a wide range, so spray characteristics of the spray nozzle according to this invention can be influenced in a wide range.

Furthermore, the spray characteristics can be influenced through a suitable choice of the distance between the first outlet orifice and the second outlet orifice in the direction of flow. The distance between the second outlet orifice and the first outlet orifice can preferably be adjusted.

It is also possible to design the enlarged area and/or the narrowed portion of the cross section so they can be adjusted.

DESCRIPTION OF THE DRAWING

The single FIGURE shows a cross section of the spray nozzle of the present invention.

With the FIGURE the invention can be explained in greater detail in one embodiment.

The spray nozzle illustrated in the figure has a housing 1 with an outside thread for screwing the spray nozzle into a water line (not shown). The housing has a cylindrical inside wall 3 that develops into a conical inside wall 4 which in turn leads to a first outlet orifice 5. On the inlet end 6 the housing 1 has an inside thread 7 into which a nozzle part 8 with an outside thread 9 is screwed. A first helical channel 11 and other helical channels not illustrated in the figure are provided in the outside wall 10 of nozzle part 8 to supply water and run around a vortex axis 12 as indicated by a dash-dot line, opening tangentially into a vortex chamber 13 formed between nozzle part 8 and the cylindrical inside wall 3 or the conical inside wall 4 of the housing. A second channel 14 that is coaxial with the vortex axis 12 is provided in nozzle part 8 to supply water. The second channel 14 has a first cylindrical wall area 15 that develops via a conically tapered wall area 16 into a second cylindrical wall area 17 having a smaller cross section and leading to an area with a reduced cross section 18. This reduced cross section 18 is in turn followed by an enlarged area formed by a second conical wall area 19 of the second channel 14 that develops into a third cylindrical wall area 20. The third cylindrical wall area 20 leads to a second outlet orifice 21.

When the spray nozzle illustrated in the figure is used, water flows through the first helical channel 11 to the first outlet orifice 5. A twist is imparted to the flowing water as it passes through the spiral channel 11, its velocity increasing greatly as it approaches the first outlet orifice 5 on the inside radially, so the water is distributed in a spray mist on leaving the first outlet orifice 5 and spreads out in the form of a spray cone in front of the spray nozzle.

In addition, water also flows through the second channel 17. After the water passes through the portion 18 with a reduced cross section, the water pressure drops in the enlarged area formed by the second conical wall 19. Thus, a zone where the pressure is reduced is formed in the enlarged area so the water flowing through this zone forms a spray mist that comes out the second outlet orifice 21 and spreads out inside the spray cone coming out of the first outlet orifice 5, thus yielding a uniform fire extinguishing effect with the spray nozzle.

What is claimed is:

1. A water spray nozzle, for spraying water in fire prevention systems to extinguish fires, having a housing, having a vortex chamber construed and arranged to define a vortex inside the housing into which at least one first channel communicating with a water supply for supplying water opens tangentially at a distance from the axis of the vortex and which has a first outlet orifice coaxial with the axis of the vortex, the water leaving the first outlet orifice in the form of a water spray cone in front of the water spray nozzle, and having a second outlet orifice coaxial with the first outlet orifice inside the vortex chamber at the end of a second channel (14) that is coaxial with the axis (12) of the vortex, characterized in that upstream from the second outlet orifice (21) the second channel (14) has an enlarged area where the cross-sectional area normal to the axis of the second channel increases in the direction of water flow; the cross-sectional area of the second channel (14) normal to the axis of the second channel does not decrease further downstream from the enlarged area with respect to the direction of water flow; the second outlet orifice (21) is arranged closed to the first outlet orifice (5) and upstream from said first outlet orifice with respect to the direction of water flow so that the stream of water coming out of the second outlet orifice (21) and distributed radially due to the reduced pressure prevailing in the enlarged area of the second channel (14) spreads out as a water spray mist inside the water spray cone leaving the first outlet orifice thus, thus providing for a uniform fire extinguishing effect.

2. A water spray nozzle according to claim 1, characterized in that the enlarged area is foxed downstream from a reduced cross-sectional area (16, 18) in the second channel (14) as seen in the direction of water flow.

3. A water spray nozzle according to claim 1, characterized in that the enlarged area is formed by a conical wall area (19) in the second channel (14).

4. A water spray nozzle according to claim 2, characterized in that the reduced cross-sectional area (16, 18) is designed so it decreases in size gradually in the direction of water flow.

5. A water spray nozzle according to claim 1, characterized in that a noble part (8) is provided in the housing (1) and the first channel (11) is formed on the outside (10) and the second channel (14) is formed in the center.

6. A water spray nozzle according to claim 1, characterized in that the distance between the second outlet orifice (21) and the first outlet orifice (5) is adjustable in order to adjust the spray characteristics of the water.

7. A water spray nozzle for spraying water in a fire prevention system to extinguish fires, having a housing, said housing having a vortex chamber constructed and arranged to define a vortex inside the housing, a first helical channel means in the housing for communicating with a water supply and with the vortex for supplying water to the vortex tangentially at a distance from the axis of the vortex and which housing has a first outlet orifice coaxial with the axis of the vortex, the water leaving the first outlet orifice in the form of a water spray cone in front of the water spray nozzle, and the housing having a second outlet orifice coaxial with the first outlet orifice inside the vortex chamber at the end of a second channel that is coaxial with the axis of the vortex, the second channel communicating with a water supply, the second channel having an enlarged area upstream from the second outlet orifice where the cross sectional area normal to the axis of the second channel increases in the direction of water flow; the cross-sectional area of the second channel normal to the axis of the second channel does not decrease further downstream from the enlarged area with respect to the direction of water flow, the second outlet orifice being arranged close to the first outlet orifice and upstream from said first outlet with respect to the direction of water flow that the stream of water coming out of the second outlet orifice and distributed radially due to the reduced pressure prevailing in the enlarged area of the second channel spreads out as a water spray mist inside the water spray cone leaving the first outlet orifice, thus providing for a substantially uniform water mist at the open end of the water spray cone, so as to provide a uniform fire extinguishing effect.

8. A method of spraying water to extinguish fires from a water spray nozzle comprising a housing having a vortex chamber constructed and arranged to define a vortex inside the housing into which at least one first channel communicating with a water supply for supplying water opens essentially tangentially at a distance from the axis of the vortex, and which has a first outlet orifice coaxial with the axis of the vortex and having a second outlet orifice coaxial with the first outlet orifice inside the vortex chamber at the end of a second channel that is coaxial with the axis of the vortex, comprising the steps of discharging the water from the first outlet orifice in the form of a water spray cone in front of the water spray nozzle and discharging the water from the second orifice outlet in the form of water spray mist inside the water spray cone leaving the first outlet orifice for providing for a uniform fire extinguishing effect.

* * * * *

UNITED STATES PATENT AND TRADEMARK OFFICE

CERTIFICATE OF CORRECTION

PATENT NO. : 6,129,154
DATED : October 10, 2000
INVENTOR(S) : Rolf Hoffmann; Jörg Mücke and Wilfried Heize It is certified that error appears in the above-identified patent and that said Letters Patent is hereby corrected as shown below:

Title page,
Item [73], the address should read -- Bad Oldesloe -- rather than "BedOldesloe"".

Claim 8,
Line 6 (Column 6, line 18), delete "essentially".

Signed and Sealed this

Twenty-third Day of October, 2001

*Attest:*

Nicholas P. Godici

NICHOLAS P. GODICI
*Acting Director of the United States Patent and Trademark Office*

*Attesting Officer*